US007422360B2

(12) United States Patent
Kozyuk

(10) Patent No.: US 7,422,360 B2
(45) Date of Patent: Sep. 9, 2008

(54) FLUID IMPINGEMENT MIXING DEVICE

(75) Inventor: Oleg V. Kozyuk, North Ridgeville, OH (US)

(73) Assignee: Cavitech Holdings, LLC, Independence, OH (US)

( * ) Notice: Subject to any disclaimer, the term of this patent is extended or adjusted under 35 U.S.C. 154(b) by 179 days.

(21) Appl. No.: 11/063,360

(22) Filed: Feb. 23, 2005

(65) Prior Publication Data

US 2006/0187748 A1 Aug. 24, 2006

(51) Int. Cl.
*B01F 5/02* (2006.01)
*B01F 5/06* (2006.01)

(52) U.S. Cl. ..... 366/162.4; 366/176.1

(58) Field of Classification Search ... 366/176.1–176.4, 366/162.4, 336–340, 181.5; 138/40; 516/928–931; 137/896

See application file for complete search history.

(56) References Cited

U.S. PATENT DOCUMENTS

| | | | | |
|---|---|---|---|---|
| 1,496,858 | A | 6/1924 | Knollenberg | |
| 2,751,335 | A | 6/1956 | Carver et al. | |
| 2,890,868 | A | 6/1959 | Potchen | |
| 3,701,484 | A | 10/1972 | Donovan | |
| 3,833,718 | A | 9/1974 | Reed et al. | |
| 4,533,254 | A | 8/1985 | Cook et al. | |
| 4,534,388 | A * | 8/1985 | Pall et al. | 138/37 |
| 4,908,154 | A | 3/1990 | Cook et al. | |
| 5,366,287 | A | 11/1994 | Verstallen | |
| 5,380,089 | A | 1/1995 | Karasawa | |
| 5,417,957 | A | 5/1995 | Coe et al. | |
| 5,465,913 | A | 11/1995 | Naito | |
| 5,466,646 | A | 11/1995 | Moser | |
| 5,482,369 | A | 1/1996 | Verstallen | |
| 5,492,654 | A * | 2/1996 | Kozjuk et al. | 366/336 |
| 5,852,076 | A | 12/1998 | Serafin et al. | |
| 6,051,630 | A | 4/2000 | Serafin et al. | |
| 6,126,948 | A | 10/2000 | Simonnet et al. | |
| 6,159,442 | A | 12/2000 | Thumm et al. | |
| 6,221,332 | B1 | 4/2001 | Thumm et al. | |
| 6,227,694 | B1 | 5/2001 | Mitake et al. | |
| 6,502,979 | B1 * | 1/2003 | Kozyuk | 366/176.2 |
| 6,923,213 | B2 * | 8/2005 | Serafin et al. | 137/896 |
| 2006/0187748 | A1 * | 8/2006 | Kozyuk | 366/162.4 |
| 2007/0140046 | A1 * | 6/2007 | Serafin et al. | 366/162.4 |

FOREIGN PATENT DOCUMENTS

| | | | |
|---|---|---|---|
| EP | 1352682 | A1 * | 10/2003 |
| GB | 741756 | | 2/1953 |
| GB | 2 063 695 | A | 6/1981 |
| JP | 7-116487 | | 5/1995 |
| JP | 10-43562 | * | 2/1998 |
| JP | 10296114 | A | 11/1998 |
| JP | 2000126042 | A | 5/2000 |

OTHER PUBLICATIONS

P. Marie, et al., "Influence of major parameters in emulsification mechanisms using a high-pressure jet", Journal of Food Engineering 53 (2002) 43-51.

* cited by examiner

*Primary Examiner*—Charles E Cooley
(74) *Attorney, Agent, or Firm*—Benesch, Friedlander, Coplan & Aronoff LLP

(57) ABSTRACT

Methods and devices for mixing fluids are described. One exemplary method includes producing hollow cylinders of fluid, flowing the cylinders toward one another along the surface of a cylinder, and colliding the cylinders head-on to produce a radial outflow of fluid and cavitation bubbles.

6 Claims, 9 Drawing Sheets

FLUID IMPINGEMENT MIXING DEVICE

BACKGROUND

Various processes and devices may be used to mix fluids. For example, mixtures, blends, admixtures, solutions, homogenates, emulsions, and the like may be produced by processes and devices for mixing fluids. The processes and devices may additionally/alternatively be used to initiate and/or sustain chemical reactions using reactants from the same or separate fluids.

In one example method, cavitation may be used to mix liquids. Cavitation is related to formation of bubbles and cavities within liquids. Bubble formation may result from a localized pressure drop in the liquid. For example, if the local pressure of a liquid decreases below its boiling point, vapor-filled cavities and bubbles may form. As the pressure then increases, vapor condensation may occur in the bubbles and the bubbles may collapse, creating large pressure impulses and high temperatures. The impulses and/or high temperatures may be used for mixing, initiating/sustaining chemical reactions, and the like.

BRIEF DESCRIPTION OF THE DRAWINGS

The accompanying drawings, which are incorporated in and constitute a part of the specification, illustrate various example methods, devices, and so on which, together with the detailed description given below, serve to describe the example embodiments of the methods, devices, and so on. The drawings are for the purposes of understanding and illustrating the preferred and alternative embodiments and are not to be construed as limitations. As one example, one of ordinary skill in the art will appreciate that one element may be designed as multiple elements or that multiple elements may be designed as one element. An element shown as an internal component of another element may be implemented as an external component and vice versa.

Further, in the accompanying drawings and descriptions that follow, like parts or components are normally indicated throughout the drawings and description with the same reference numerals, respectively. The figures are not necessarily drawn to scale and the proportions of certain parts or components may have been exaggerated for convenience of illustration.

DETAILED DESCRIPTION

This application describes example methods and devices for mixing fluids. The methods and devices generally facilitate production of hollow fluid cylinders and flowing the hollow cylinders directly toward one another along the surface of a shaft or cylinder. The flowing hollow cylinders (e.g., jets or streams) normally collide or impinge one another head-on along the surface of the shaft or cylinder, thereby causing the dimensions and direction of flow of the two hollow streams of fluid to change. For example, as a result of the impingement, a radial outflow of fluid may be directed outward from the surface of the cylinder as, for example, a fluid film. There normally will be compression-tension deformation, vorticity, and/or low pressure within the radial outflow of fluid, resulting in formation of cavitation bubbles. Collapse of the cavitation bubbles normally results in mixing of the fluids.

Figure 1:
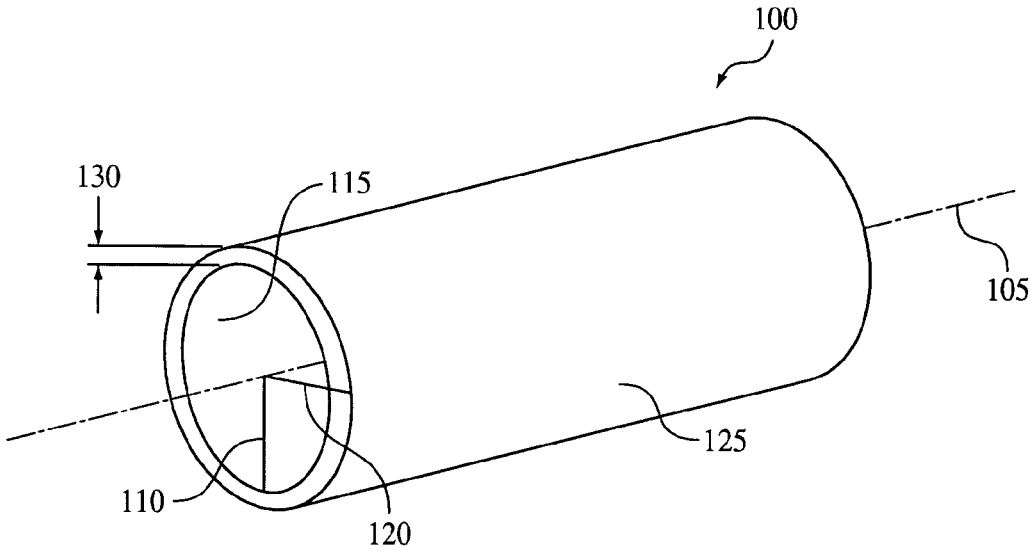
FIG. 1 illustrates an example hollow cylinder of fluid 100.

FIG. 1 illustrates an example hollow cylinder of fluid 100. The hollow cylinder of fluid 100 may be called an extended annular body of fluid. Generally, the shape of the body of fluid is cylindrical, but it may have other shapes. Generally, the shape of the body of fluid includes a hollow center portion. In the form of a hollow cylinder, the body of fluid 100 may be described in relation to a longitudinal axis 105 that runs down the center of the length of the hollow cylinder of fluid 100. The hollow cylinder of fluid 100 has an interior diameter 110, measured as the shortest distance from a point on the longitudinal axis 105 to the interior surface 115 of the hollow cylinder of fluid 100. The hollow cylinder of fluid 100 also has an exterior diameter 120, measured as the shortest distance from a point on the longitudinal axis 105 to the exterior surface 125 of the hollow cylinder of fluid 100. The difference between the exterior diameter 120 and the interior diameter 110 of a hollow cylinder of fluid 100 may be termed the "wall thickness" 130 or "thickness" 130 of the cylinder of fluid 100. The thickness 130 of the hollow cylinder of fluid 100, or of a body of fluid of another shape, may vary. In one embodiment, a practitioner/user of the methods and devices described herein may establish or select a thickness 130 based, at least in part, on a collection of factors, such as a thickness that will facilitate cavitation and will also facilitate a sufficient volume of fluid to be processed in a set time by the methods and devices described herein.

Figure 2A:
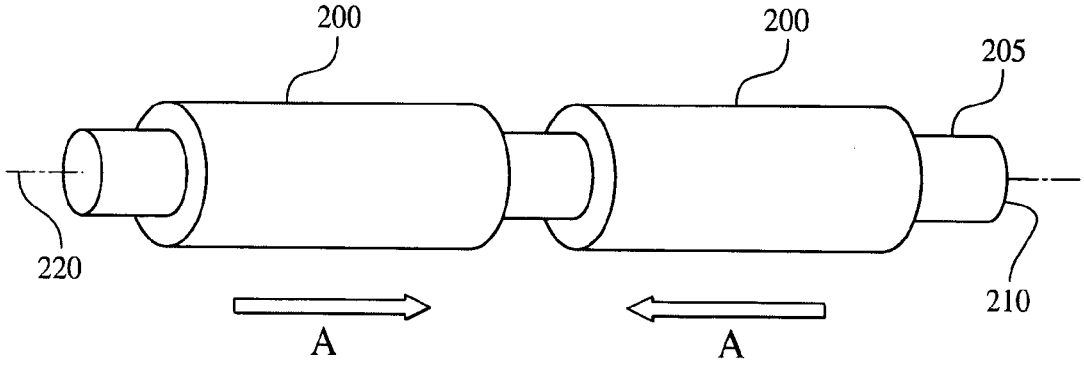
FIG. 2A illustrates an example of two hollow cylinders of fluid 200 moving along an external lateral surface 205 of a cylinder 210.

FIG. 2A illustrates an example of two hollow cylinders of fluid 200 moving along an external lateral surface 205 of a cylinder 210. The example methods and devices described herein generally facilitate formation of at least two hollow cylinders of fluid 200. The hollow cylinders of fluid may have the same dimensions (e.g., the same interior diameter, exterior diameter, and thickness). The hollow cylinders of fluid 200 move or flow toward one another, in the directions indicated by arrows A in the illustration. When moving, the hollow cylinders of fluid 200 may be referred to as "streams" or "jets." In the illustration, the two hollow cylindrical streams or annular streams 200 flow along the external lateral surface 205 of the cylinder 210. As shown in the illustrated example, the two hollow cylindrical streams 200 flow directly toward one another along the longitudinal axis 220. Generally, the speed or velocity with which the streams or jets flow toward one another facilitates formation of cavitation bubbles. Formation of cavitation bubbles is described in more detail later.

Figure 2B:
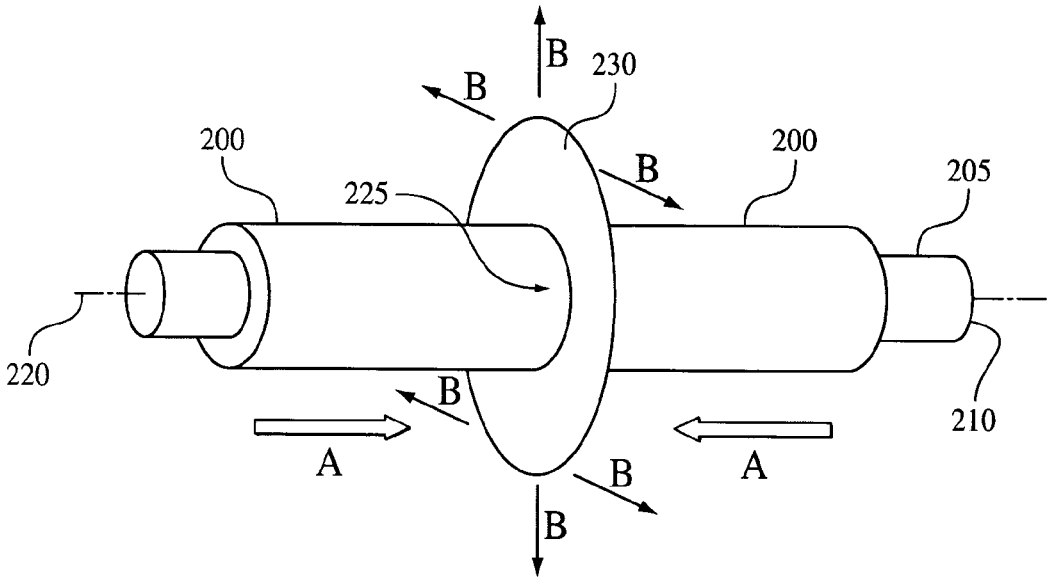
FIG. 2B illustrates an example of impingement of two hollow streams of fluid 200 along an external lateral surface 205 of a cylinder 210, producing a radial outflow of fluid 230.

FIG. 2B illustrates an example of impingement or collision of two hollow streams of fluid 200 along an external lateral surface 205 of a cylinder 210, producing a radial outflow of fluid 230. As the two hollow cylindrical streams 200 flow toward one another along an external lateral surface 205 of a cylinder 210, in a direction as shown by the arrows A, the streams collide or impinge at a common contact or impingement zone 225. Impingement of the streams may occur in a "head-on" manner, indicating that impingement generally results from streams flowing directly toward one another along the same longitudinal axis 220.

Impingement generally results in a change in a number of parameters and/or characteristics of the streams 200. For example, impingement normally results in a change in at least the configuration and direction of the streams 200. As shown in the example in FIG. 2B, impingement of the two streams 200 generally results in merging of the multiple streams 200 into a single stream that generally flows outward from the exterior surface of the cylinder 205, in a direction substantially perpendicular to the exterior surface of the cylinder 205. Generally, the single stream flows outward from the exterior surface of the cylinder 205 in all directions (e.g., 360°). This single stream may be called a radial outflow of fluid 230. In the illustrated example, the radial outflow of fluid 230 appears as a sheet or film of fluid flowing outward in all directions (see arrows B), in a plane that is substantially perpendicular to the external lateral surface 205 of the cylinder 210. In one example, the thickness of the fluid film of the radial outflow 230 may be significantly small that the radial outflow 230 may said to be "two-dimensional" or "flat." Relative to the thickness of the radial outflow of fluid 230, the hollow cylindrical streams 200 may be said to be "three-dimensional."

Impingement or collision of the multiple hollow streams, and the changes in the configuration and direction of the streams, may cause compression-tension deformation, vorticity, and/or localized areas of low pressure in the radial outflow of fluid 230. Generally, cavitation bubbles may form. The cavitation bubbles may be localized in the radial outflow of fluid. Cavitation bubbles generally may form when the velocity of the radial outflow 230 is at least 30 meters per second. Collapse of the cavitation bubbles may produce impulses, high temperatures, mixing effects, and the like. A static pressure may facilitate collapse of the cavitation bubbles.

Figure 3:
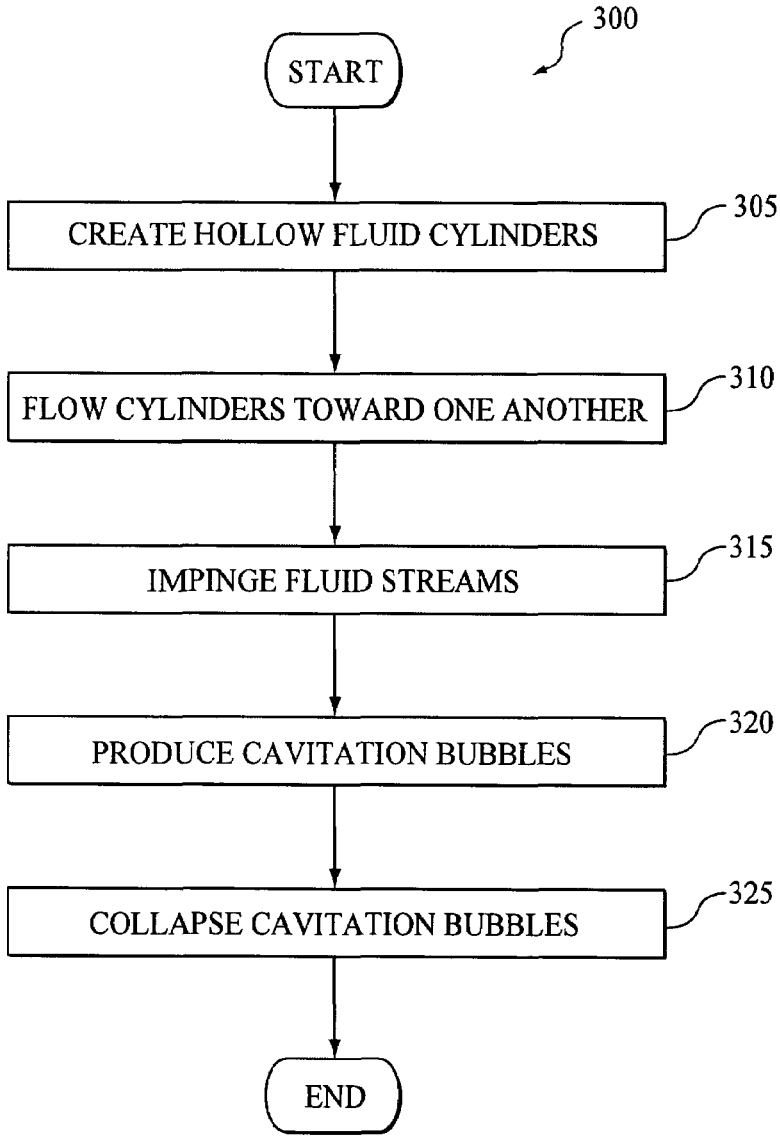
FIG. 3 illustrates an example method 300 for mixing fluids.

Example methods for mixing fluids, as described herein, may be better appreciated by reference to the flow diagram of FIG. 3. While for purposes of simplicity of explanation, the illustrated methodology is shown and described as a series of blocks, it is to be appreciated that the methodology is not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks. While the figures illustrate various actions occurring in serial, it is to be appreciated that various actions could occur concurrently, substantially in parallel, and/or at substantially different points in time.

FIG. 3 illustrates an example method 300 for mixing fluids. Method 300 may include, at 305, creating or forming hollow cylinders of fluid. In one example, forming hollow streams of fluid may be accomplished by flowing a fluid through an annular processing passage, as is described below. Method 300 may also include, at 310, flowing the hollow cylinders/streams of fluid toward one another, generally along an exterior lateral surface of a cylinder. Method 300 may also include, at 315, colliding or impinging the hollow streams with one another. Generally, impingement of the streams is head-on. Method 300 may also include, at 320, producing cavitation bubbles. Formation of cavitation bubbles generally is facilitated by impingement of the hollow streams and changes in the configuration and direction of the streams, including producing a radial fluid outflow. Method 300 may also include, at 325, collapsing the cavitation bubbles. Collapsing the cavitation bubbles may occur by creating a static pressure in the area where the cavitation bubbles are located. The static pressure generally is higher than the pressure in the areas where cavitation bubbles are formed. The area where the cavitation bubbles are located may include the contact or impingement zone and surrounding areas including the area where the radial fluid outflow is located.

Figure 4:
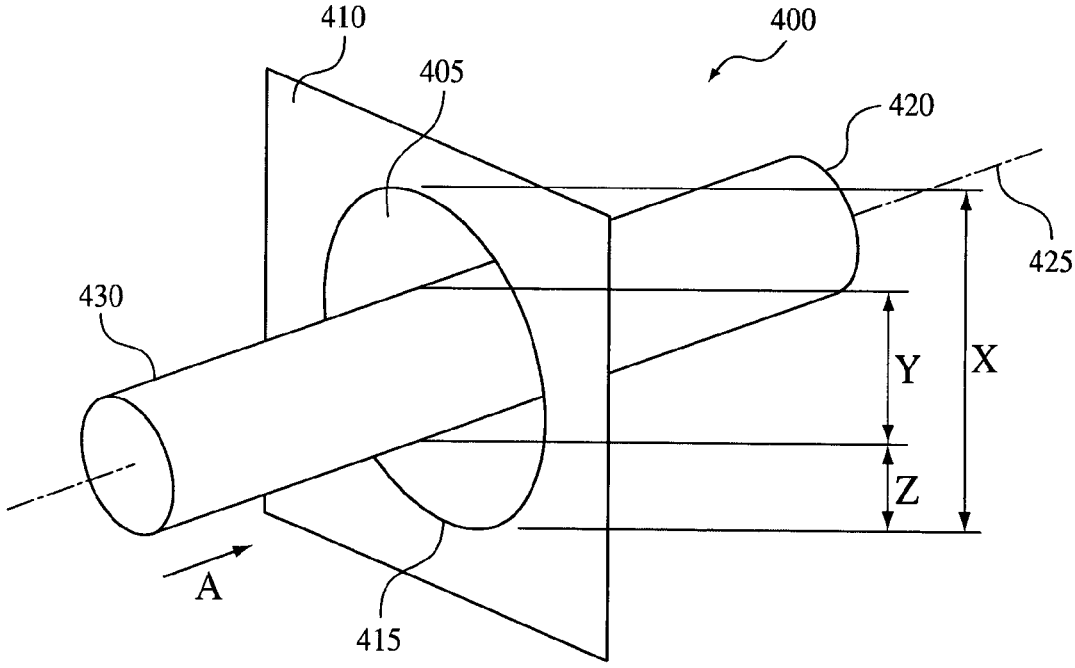
FIG. 4 illustrates an example configuration of components 400 for producing hollow fluid streams.

FIG. 4 illustrates an example configuration of components 400 for producing hollow fluid streams. In the illustrated example, an annular processing passage 405 is formed by the relative placement of a plate 410 or other structure having a circular opening 415, and a cylinder 420 or shaft 420 having a longitudinal axis 425 and an external lateral surface 430. The annular processing passage 405 may also be called a center-plugged orifice, annular opening, annular passage or annular orifice. In the illustration, the annular processing passage 405 is ring-shaped. In the illustration, the longitudinal axis 425 is perpendicular to the plane of the plate 410. The circular opening 415 has a center (not shown; e.g., a line indicating the diameter of the circular opening 415 passes through the "center" of the circular opening 415). The annular processing passage 405 may be said to be concentric with the cylinder 420. In the illustration, the center of the circular opening 415 is aligned with the longitudinal axis 425 of the cylinder 420. The cylinder 420 is coaxially positioned through the circular opening 415. The circular opening 415 in the plate 410 has diameter X (diameter X can also be called the "exterior diameter of the annular processing passage"). The cylinder 420 has diameter Y. In the illustrated configuration, diameter Y acts as and can be called the "interior diameter of the annular processing passage." The difference between diameter X and diameter Y can be called the "gap size." Gap size is indicated by distance Z in the illustration. Gap size is one measure of the size of the annular processing passage 405. Other example configurations may be used to provide an annular processing passage. One example of this is described below.

Using the configuration 400 illustrated in FIG. 4, a hollow stream of fluid may be produced by flowing a fluid through the annular processing passage 405. Generally, the fluid may be flowed through the annular processing passage 405, in the direction of arrow A, under a pressure, to produce a hollow cylinder of fluid similar to that shown as 200 in FIG. 2A. The hollow cylinder of fluid generally is created, produced or formed along the external lateral surface 430 of the cylinder 420. The hollow cylinder of fluid flows along the external lateral surface 430 of the cylinder 420 in the direction of arrow A and may be called a "stream" or "jet". If the fluid is flowed through the annular processing passage 405 in a continuous fashion, a continuous hollow stream of may be produced. Generally, the interior diameter of the stream (e.g., 110 in FIG. 1) may be substantially the same as diameter Y of the cylinder 420. Generally, the exterior diameter of the stream (e.g., 120 in FIG. 1) may be substantially the same as diameter X of the circular opening 415 in the plate 410. Generally, the thickness of the stream is substantially the same as the gap size (distance Z in FIG. 4). That is, the thickness of the stream generally is substantially the same as the difference between diameter X and diameter Y.

The methods and devices described herein generally facilitate at least two hollow streams of fluid flowing toward one another, generally along the same surface, and colliding head-on with one another along the surface. One of ordinary skill in the art will appreciate that the arrangement shown in FIG. 4 can be modified to produce two hollow streams of fluid flowing toward one another. One arrangement like this is described below.

Figure 5:
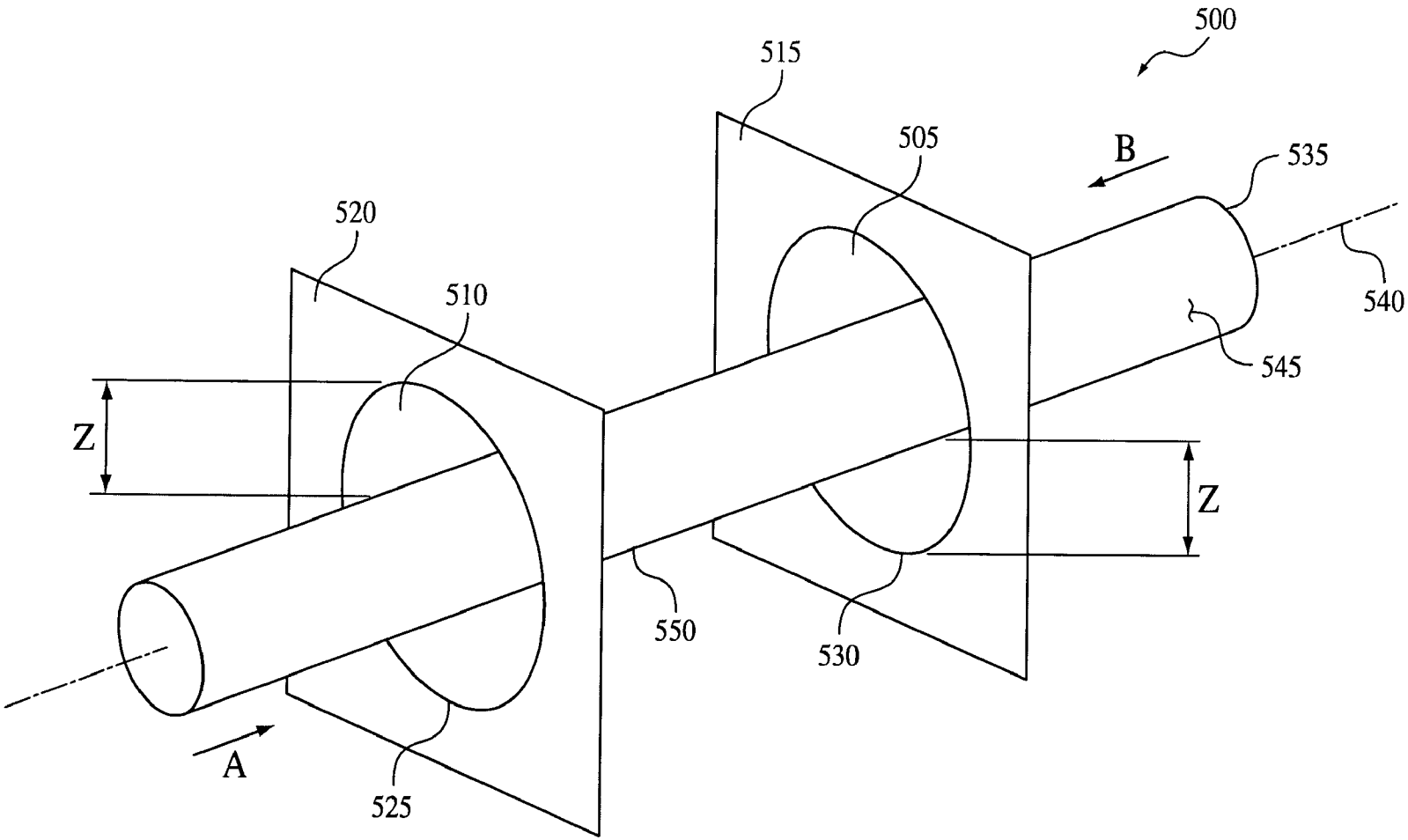
FIG. 5 illustrates an example configuration of components 500 for producing and colliding hollow fluid streams.

FIG. 5 illustrates an example configuration of components 500 for producing and colliding hollow fluid streams. In the illustrated example, two annular processing passages 505, 510 are formed by the relative placement of two plates 515, 520, or other structures, having circular openings 525, 530, along a length of a cylinder 535 having a longitudinal axis 540 and an external lateral surface 545. The circular openings 525, 530 are spaced-apart and coaxial with each other. The length of the cylinder 535 located between the two plates 515, 520 may be called a spaced-length 550 of cylinder. In the illustration, the longitudinal axis 540 is perpendicular to the plane of each plate 515, 520. The cylinder 535 is coaxially positioned through the circular openings 525, 530. In one example, the circular openings 525, 530 of the two plates 515, 520 may have the same diameters. In one example, the gap sizes of both annular processing passages 505, 510 may be the same (distances Z). Other example configurations may be used.

Using the configuration 500 illustrated in FIG. 5, a fluid flowed in the direction of arrow A, through a first processing passage 510, will produce a hollow stream of fluid flowing in the direction of arrow A. A fluid flowed in the direction of arrow B, through a second processing passage 505, will produce a hollow stream of fluid flowing in the direction of arrow B. Generally, the hollow streams of fluid are produced along the external lateral surface 545 of the cylinder 535. The two hollow cylinders of fluid, one flowing in the direction of arrow A and one flowing in the direction of arrow B, will collide along the external lateral surface 545 of the cylinder 510, at a location on the spaced-length 550 of the cylinder 535. Generally, the collision will occur at an area called a contact zone or impingement zone.

It will be appreciated that the two hollow streams of fluid produced using a configuration 500 like that illustrated in FIG. 5 will flow toward one another along the same linear surface, here an external lateral surface 545 of a cylinder 535. Flowing of the two streams along the same surface 545 continues as the two streams collide with one another along the external lateral surface 545 of the spaced-length 550 of cylinder. Because the steams flow along the same linear surface 545, the streams are in direct alignment with one another at the point of collision (e.g., when the external lateral surface 545 is linear, there is no misalignment of the streams). This alignment of the streams generally facilitates collisions that facilitate formation of cavitation bubbles.

It will be appreciated that other factors affect formation of cavitation bubbles and mixing of fluids. For example, one or a combination of factors, like characteristics of the fluids that form the streams, dimensions (e.g., thickness) of the streams, the speed or velocity at which multiple streams collide, and other factors, may affect formation of cavitation bubbles.

A practitioner may establish a particular set of conditions and/or factors that facilitate cavitation bubble formation and fluid mixing by empirically varying some or all of the factors that affect formation of cavitation bubbles and mixing of fluids. This establishment and optimization of conditions may be facilitated by use of the methods and devices described herein on a small scale. In one example, a configuration of components 500 as illustrated in FIG. 5 may be used. To minimize the volume of fluids to be processed in the optimization experiments, diameters of circular openings 525, 530 in the plates 515, 520 may be in the range of 0.1 to 10 millimeters, for example. Once optimum conditions are established, the practitioner may desire to scale-up or increase the volume of fluids that can be processed by the methods and devices described herein. In one example, the practitioner may increase, by the same amount, both the diameters of the circular openings 525, 530 in the plates 515, 520 (e.g., the exterior diameter of the annular processing passage) and the diameter of the cylinder 535 (e.g., the interior diameter of the annular processing passage). Diameters of the circular openings 525, 530 in the plates 515, 520 may be in the range of 10 to 1000 millimeters, for example. In this way, the areas of the processing passage 505, 510 increases, while the gap sizes do not. It is believed that this may be a method for scale-up of the volume of fluids processed by the described methods and devices, while affecting the ability to form cavitation bubbles to a lesser degree than if the gap size were changed. In one example, the scale-up may have minimal or no affect on cavitation bubble formation.

Some examples of devices for mixing fluids using the above-described methods are described below.

Figure 6:
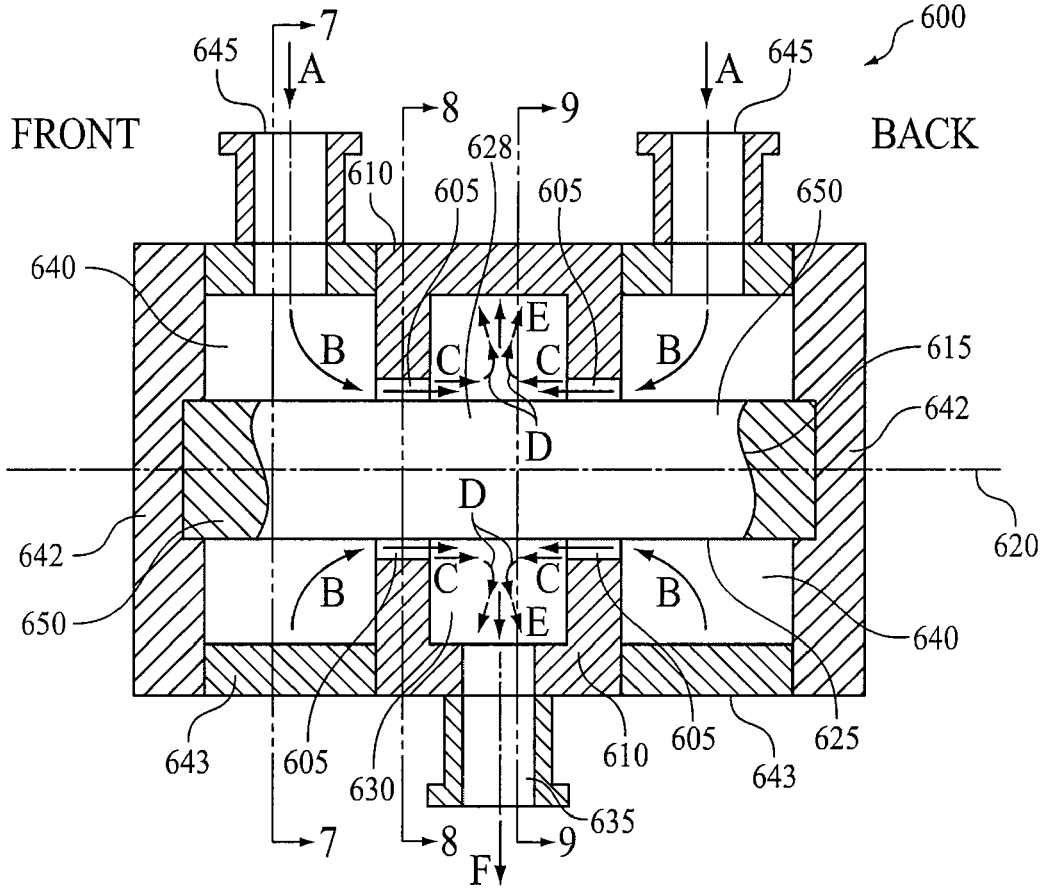
FIG. 6 illustrates a lateral sectional view of one example of a device 600 for mixing fluids. The front of the device is to the left, and the back of the device is to right on the drawing.

FIG. 6 illustrates a lateral sectional view of one example of a device 600 for mixing fluids. The example device 600 includes annular processing passages 605 formed by the relative placement of plates 610 and a cylinder 615. The cylinder 615 has a longitudinal axis 620 and an external lateral surface 625. As illustrated, the annular processing passages 605 are spaced apart along a length of the cylinder 615 to provide a spaced-length 628 of the cylinder located between the annular processing passages 605. The illustrated device 600 includes a cylindrical mixing chamber 630 surrounding the spaced-length 628 of the cylinder 615. The mixing chamber 630 is in liquid communication with the annular processing passages 605. An outlet 635 may be in liquid communication with the mixing chamber 630. The illustrated device 600 includes inlet chambers 640 surrounding the lengths of the cylinder 650 not located between the annular processing passages 605. In the illustration, an inlet chamber 640 is enclosed by an end 642, a housing wall 643, and a plate 610. Inlets 645 may be in liquid communication with the inlet chambers 640.

In operation of the device 600, fluids are flowed into the device 600 through the inlets 645 (arrows A), generally under a pressure, and into the inlet chambers 640. Generally, the pressure forces the fluids through the annular processing passages (605; arrows B) and produces two hollow fluid streams that flow toward one another (arrows C) along the external lateral surface 625 of the spaced-length 628 of the cylinder. Generally, the hollow fluid streams are formed along the external lateral surface 625. At a common contact or impingement zone, including the area in and around where the two hollow fluid streams collide with one another (arrows D), the two streams collide and the character and direction of fluid flow changes. A radial outflow steam is generally produced that flows outward from the external lateral surface 625 of the spaced-length 628 of the cylinder (arrows E). Generally, cavitation bubbles are formed. Generally, the cavitation bubbles are present in the radial outflow stream. As the radial outflow stream continues to flow outward, the confines of the mixing chamber 630 may provide a static pressure that facilitates collapse of the cavitation bubbles. A static pressure may be formed by other methods. The fluid may then flow out of the device 600 through the outlet (635; arrows F).

Figure 7:
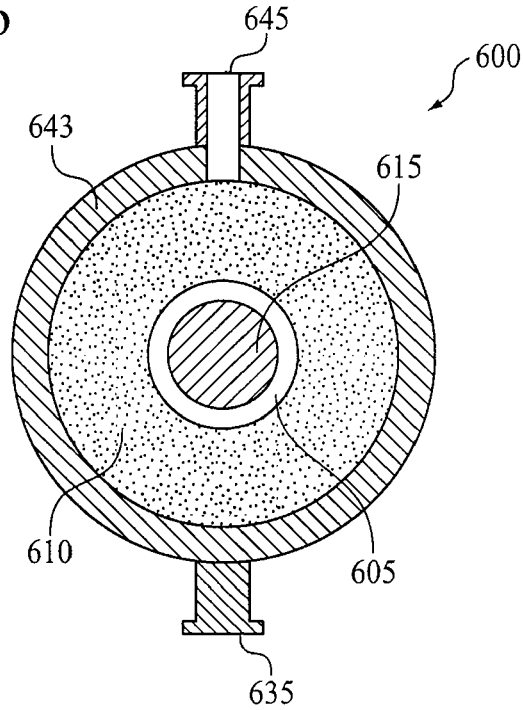
FIG. 7 illustrates a front sectional view along line 7-7 in FIG. 6 of a device 600 for mixing fluids.

FIG. 7 illustrates a front/back sectional view along line 7-7 in FIG. 6 of the device 600 for mixing fluids. Illustrated in the drawing is the annular processing passage 605, cylinder 615, plate 610, wall 643, outlet 635, and the inlet 645.

Figure 8:
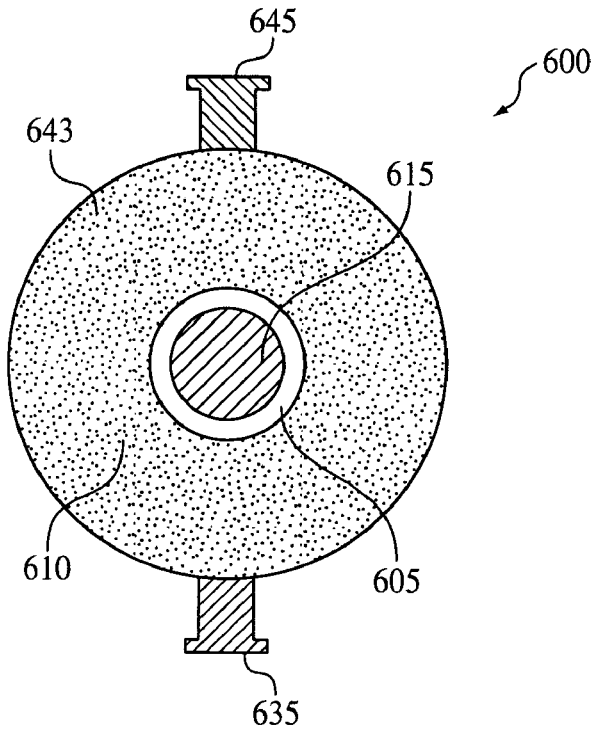
FIG. 8 illustrates a front sectional view along line 8-8 in FIG. 6 of a device 600 for mixing fluids.

FIG. 8 illustrates a front/back sectional view along line 8-8 in FIG. 6 of the device 600 for mixing fluids. Illustrated in the drawing is the annular processing passage 605, cylinder 615, plate 610, outlet 635, and the inlet 645.

Figure 9:
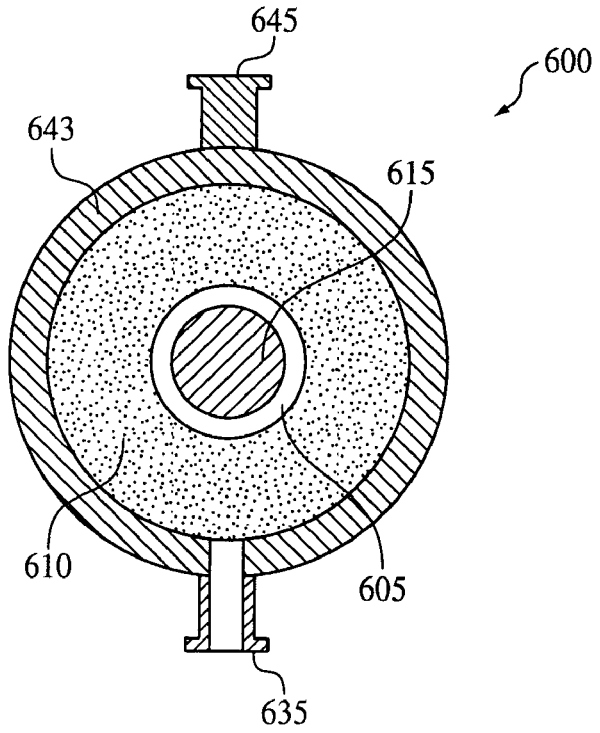
FIG. 9 illustrates a front sectional view along line 9-9 in FIG. 6 of a device 600 for mixing fluids.

FIG. 9 illustrates a front/back sectional view along line 9-9 in FIG. 6 of the device 600 for mixing fluids. Illustrated in the drawing is the annular processing passage 605, cylinder 615, plate 610, wall 643, outlet 635, and the inlet 645.

Figure 10:
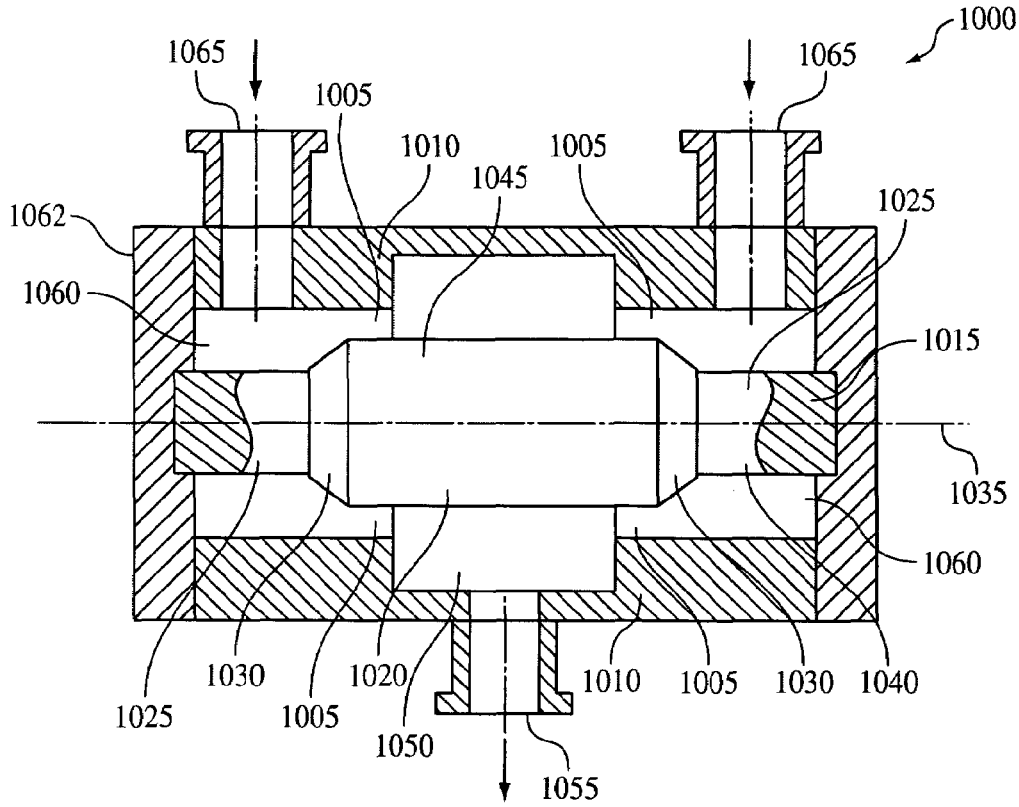
FIG. 10 illustrates a lateral sectional view of one example of a device 1000 for mixing fluids.

FIG. 10 illustrates a lateral sectional view of one example of a device 1000 for mixing fluids. The example device 1000 includes annular processing passages 1005 formed by the relative placement of a housing wall 1010 and a cylinder 1015. The cylinder 1015 has a first length 1020 connected to second lengths 1025 through beveled areas 1030. In the illustration, the diameter of the first length 1020 is larger than the diameter of the second lengths 1025. The cylinder 1015 has a longitudinal axis 1035 and an external lateral surface 1040. As illustrated, the annular processing passages 1005 are spaced apart along a length of the cylinder 1015 to provide a spaced-length 1045 of the cylinder located between the annular processing passages 1005. The illustrated device 1000 includes a cylindrical mixing chamber 1050 surrounding the spaced-length 1045 of the cylinder. The mixing chamber 1050 is in liquid communication with the annular processing passages 1005. An outlet 1055 may be in liquid communication with the mixing chamber 1050. The illustrated device 1000 includes inlet chambers 1060 surrounding the cylinder second lengths 1025, beveled areas 1030 and part of the first length 1020. In the illustration, an inlet chamber 1060 is enclosed by an end 1062 and a housing wall 1010. Inlets 1065 may be in liquid communication with the inlet chambers 1060.

Figure 11:
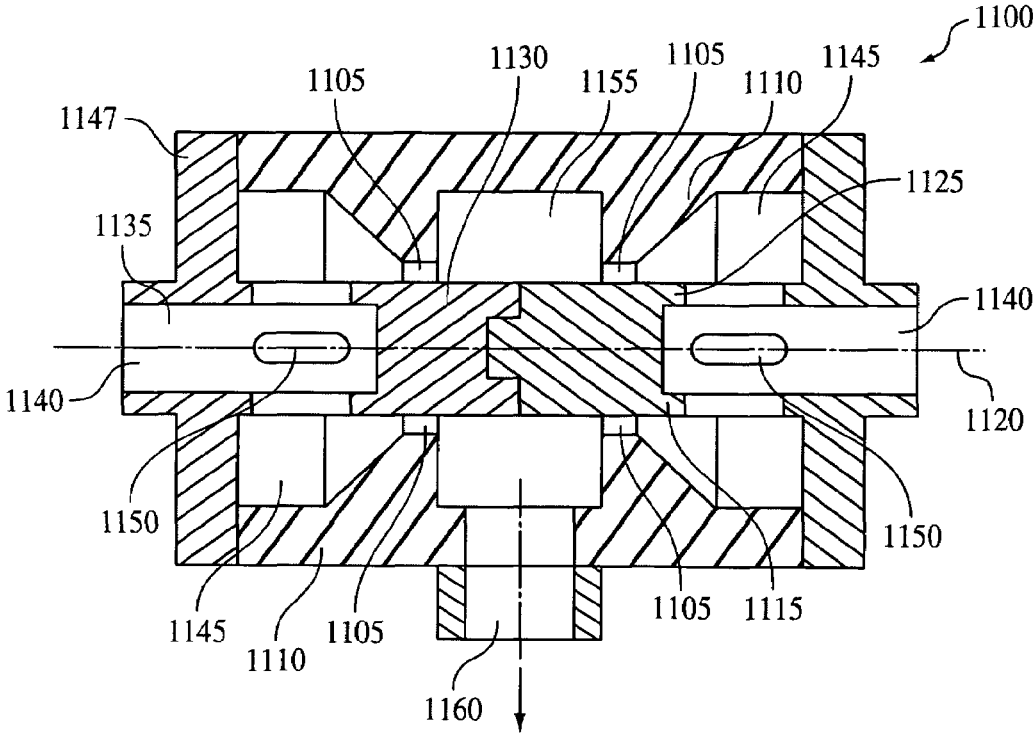
FIG. 11 illustrates a lateral sectional view of one example of a device 1100 for mixing fluids.

FIG. 11 illustrates a lateral sectional view of one example of a device 1100 for mixing fluids. The example device 1100 includes annular processing passages 1105 formed by the relative placement of a housing wall 1110 and a cylinder 1115. The cylinder has a longitudinal axis 1120 and an external lateral surface 1125. The cylinder 1115 includes a filled portion 1130 and hollow portions 1135. The hollow portions 1135 have an inlet 1140. The hollow portions 1135 are in liquid communication with inlet chambers 1145 through cylinder cutouts 1150. The inlet chambers 1145 are in liquid communication with the annular processing passages 1105. In the illustration, an inlet chamber 1145 is enclosed by an end 1147 and a housing wall 1110. The annular processing passages 1105 are in liquid communication with a mixing chamber 1155. The mixing chamber 1155 is in liquid communication with an outlet 1160.

Figure 12:
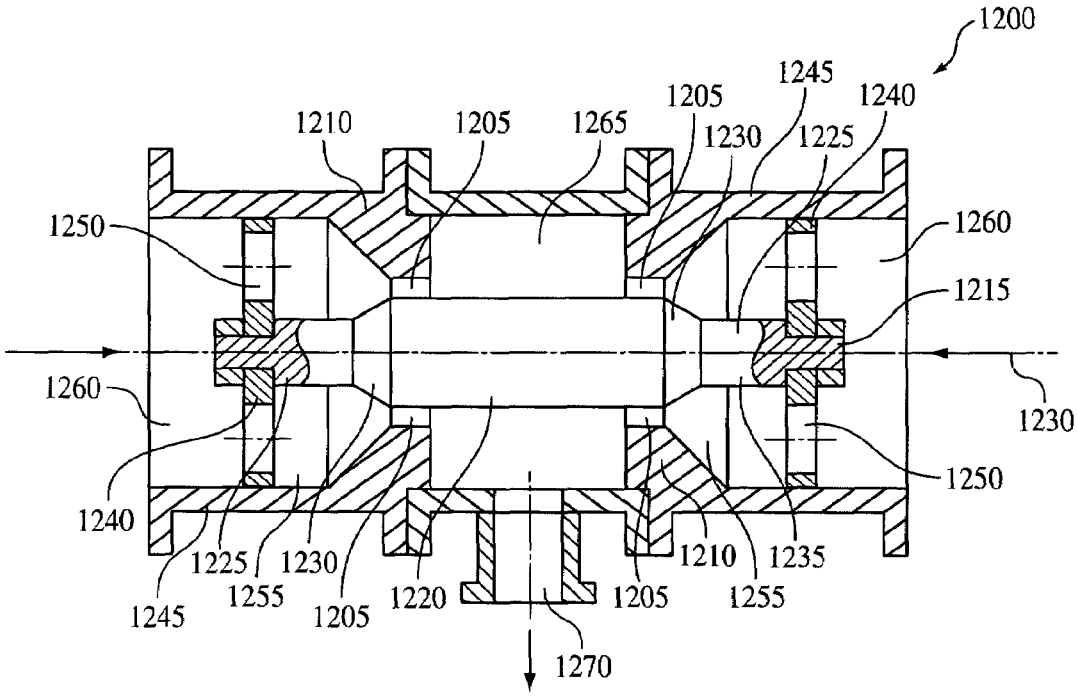
FIG. 12 illustrates a lateral sectional view of one example of a device 1200 for mixing fluids.

FIG. 12 illustrates a lateral sectional view of one example of a device 1200 for mixing fluids. The example device 1200 includes annular processing passages 1205 formed by the relative placement of a housing wall 1210 and a cylinder 1215. The cylinder 1215 has a first length 1220 connected to second lengths 1225 through beveled areas 1230. In the illustration, the diameter of the first length 1220 is larger than the diameter of the second lengths 1225. The cylinder has a longitudinal axis 1230 and an external lateral surface 1235. Near the ends of the cylinder 1215, brackets 1240 stabilize the cylinder against a housing wall 1245. The brackets 1240 have cutouts 1250 that allow fluid to flow into inlet chambers 1255 through inlets 1260. The inlet chambers 1255 are in liquid communication with the annular processing passages 1205. The annular processing passages 1205 are in liquid communication with a mixing chamber 1265. The mixing chamber 1265 is in liquid communication with an outlet 1270.

Figure 13:
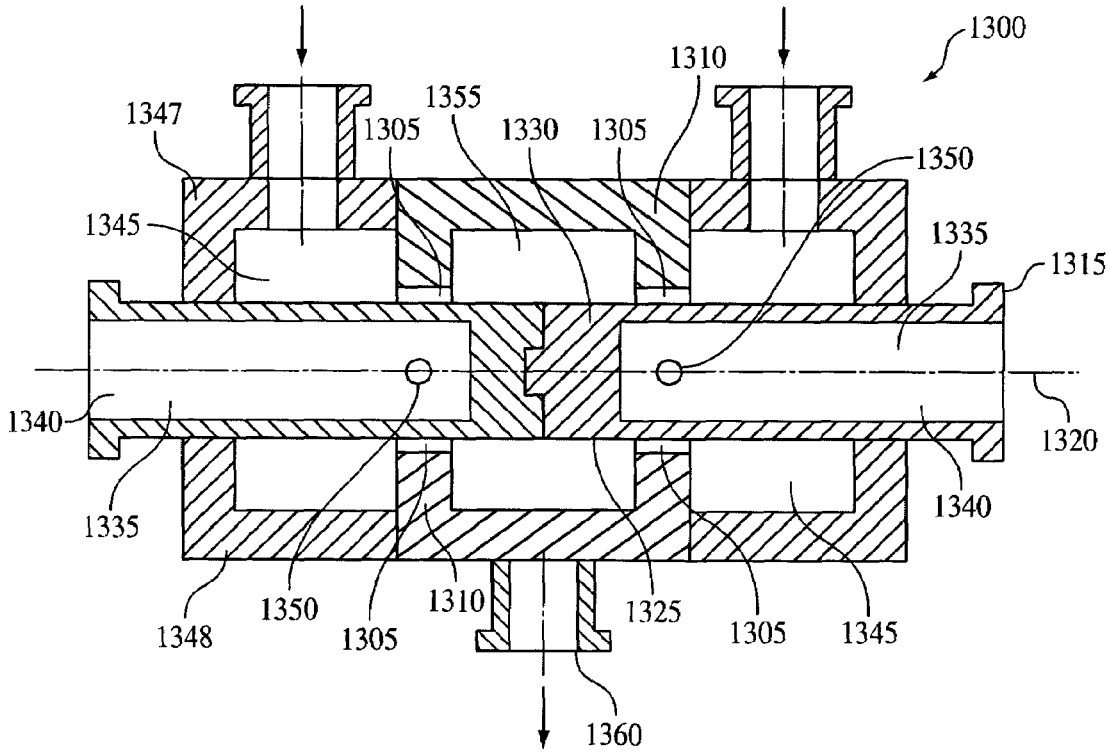
FIG. 13 illustrates a lateral sectional view of one example of a device 1300 for mixing fluids.

FIG. 13 illustrates a lateral sectional view of one example of a device 1300 for mixing fluids. The example device 1300 includes annular processing passages 1305 formed by the relative placement of plates 1310 and a cylinder 1315. The cylinder has a longitudinal axis 1320 and an external lateral surface 1325. The cylinder 1315 includes a filled portion 1330 and hollow portions 1335. The hollow portions 1335 have an inlet 1340. The hollow portions 1335 are in liquid communication with inlet chambers 1305 through cylinder cutouts 1350. The inlet chambers 1345 are in liquid communication with the annular processing passages 1305. In the illustration, an inlet chamber 1345 is enclosed by an end 1347, a housing wall 1348 and a plate 1310. The annular processing passages 1305 are in liquid communication with a mixing chamber 1355. The mixing chamber 1355 is in liquid communication with an outlet 1360.

Figure 14:
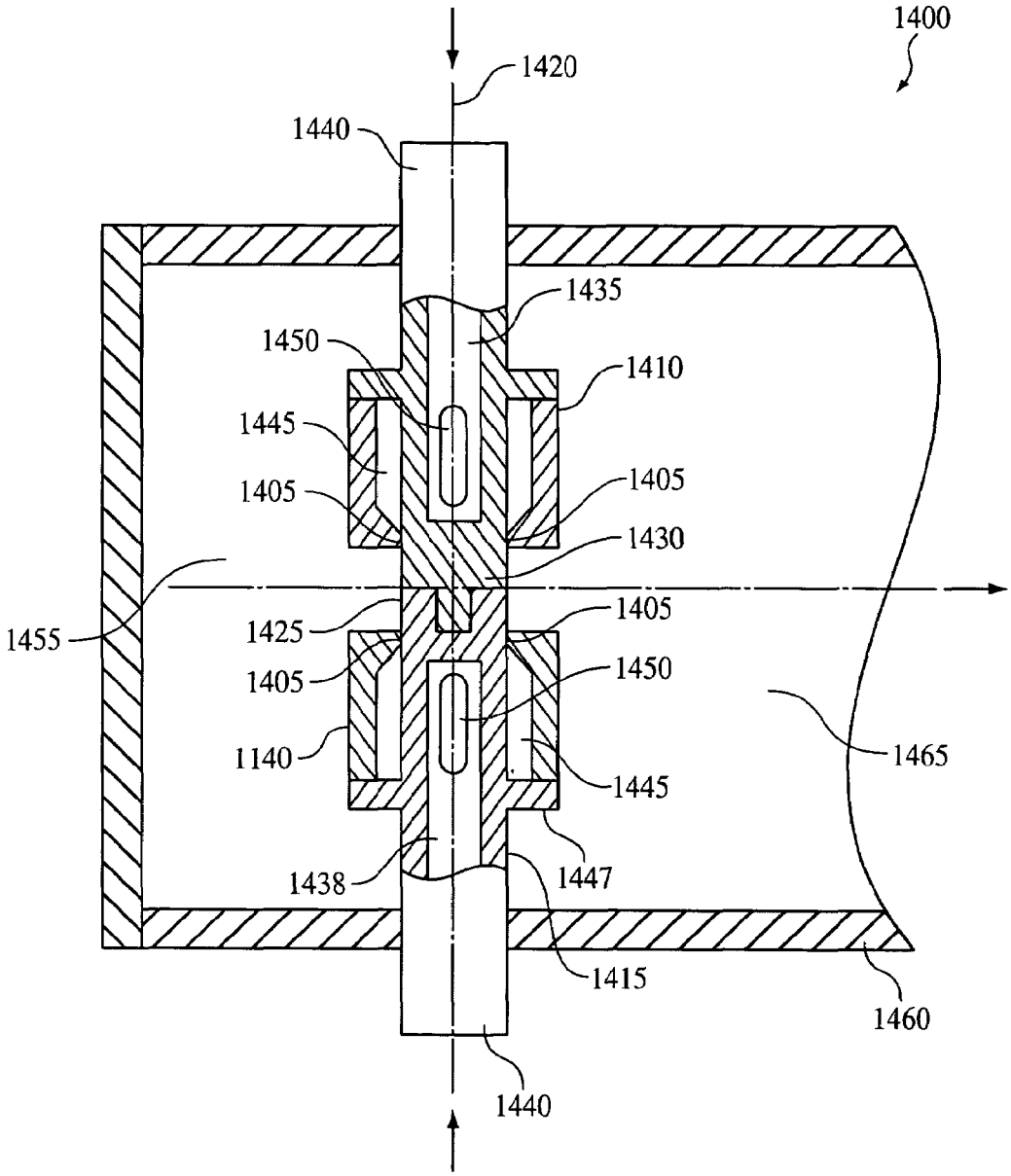
FIG. 14 illustrates a lateral sectional view of one example of a device 1400 for mixing fluids.

FIG. 14 illustrates a lateral sectional view of one example of a device 1400 for mixing fluids. The example device 1400 includes annular processing passages 1405 formed by the relative placement of chamber walls 1410 and a cylinder 1415. The cylinder has a longitudinal axis 1420 and an external lateral surface 1425. The cylinder 1415 includes a filled portion 1430 and hollow portions 1435. The hollow portions 1435 have an inlet 1440. The hollow portions 1435 are in liquid communication with inlet chambers 1445 through cylinder cutouts 1450. The inlet chambers 1445 are in liquid communication with the annular processing passages 1405. In the illustration, an inlet chamber 1445 is enclosed by an end 1447 and a chamber wall 1410. The annular processing passages 1405 are in liquid communication with a mixing chamber 1455. The mixing chamber 1455 is formed by a housing 1460. The housing 1460 has an opening 1465 at one end to permit fluid to exit the device 1400.

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

I claim:

1. A device for mixing fluids, comprising:

structure including two circular openings having substantially the same diameter, the circular openings being spaced-apart and coaxial with each other;

a fixed cylindrical shaft coaxially positioned through the circular openings to form two fixed annular openings spaced-apart along a length of the cylindrical shaft, the annular openings configured to create two hollow cylindrical fluid jets flowing directly toward one another along a lateral external surface of the cylindrical shaft when fluids are flowed through each annular opening in a direction toward a center of the cylindrical shaft; and a mixing chamber in fluid communication with the two annular openings, the mixing chamber surrounding at least the length of the cylindrical shaft spaced between the two annular openings, for enclosing the two hollow cylindrical fluid jets and a radial stream flowing outward from the lateral external surface of the cylindrical shaft that results from impingement of the two hollow cylindrical fluid jets flowing directly toward one another.

2. The device of claim 1, where the mixing chamber includes at least one outlet for flowing fluids out of the device.

3. The device of claim 1, including an inlet chamber in fluid communication with each annular opening, the inlet chamber configured to receive fluids flowing into the device.

4. A device for mixing fluids, comprising:

structure including two circular openings having substantially the same diameter, the circular openings being spaced-apart and coaxial with each other;

a fixed cylindrical shaft coaxially positioned within the circular openings to form two fixed annular openings spaced-apart along the cylindrical shaft; and a mixing chamber in fluid communication with the two annular openings, the mixing chamber surrounding at least a portion of the cylindrical shaft spaced between the two annular openings, wherein, when fluid is passed through each annular opening in a direction towards the other annular opening, opposing annular fluid streams are formed along an external surface of the cylindrical shaft, wherein, when the opposing annular fluid streams meet each other, they impinge one another to form a stream that flows radially outward from the external surface of the cylindrical shaft.

5. The device of claim 4, where the mixing chamber includes at least one outlet for flowing fluids out of the device.

6. The device of claim 5, including an inlet chamber in fluid communication with each annular opening, the inlet chamber configured to receive fluids flowing into the device.

* * * * *